United States Patent [19]

de Leaumont

[11] 4,077,174

[45] Mar. 7, 1978

[54] CONSTRUCTION ELEMENT IN PARTICULAR FOR TOWERS, SILOS OR THE LIKE

[75] Inventor: Jean de Léaumont, Reims, France

[73] Assignee: Le Ciment Arme Demay Freres, Reims, France

[21] Appl. No.: 722,839

[22] Filed: Sep. 13, 1976

[30] Foreign Application Priority Data

May 26, 1976 France ..... 76 16092

[51] Int. Cl.[2] ..... E04B 1/60

[52] U.S. Cl. ..... 52/259; 52/245; 52/285; 52/438; 52/584

[58] Field of Search ..... 52/215, 587, 259, 280, 52/583, 246, 247, 285, 438, 437, 584, 79.11

[56] References Cited

U.S. PATENT DOCUMENTS

| | | | |
|---|---|---|---|
| 954,831 | 4/1910 | Underwood | 52/583 |
| 1,261,454 | 4/1918 | Stafford | 52/245 |
| 1,302,727 | 5/1919 | Thomas | 52/584 X |
| 1,439,650 | 12/1922 | Thomas | 52/584 X |
| 1,624,802 | 4/1927 | Rebell | 52/259 |
| 2,887,740 | 5/1959 | Potchen | 52/584 X |
| 2,947,118 | 8/1960 | Rockwell | 52/583 X |
| 2,958,983 | 11/1960 | Hoover | 52/583 X |
| 3,486,282 | 12/1969 | Moriarity | 52/285 X |
| 3,803,788 | 4/1974 | Artmann | 52/587 X |

FOREIGN PATENT DOCUMENTS

| | | | |
|---|---|---|---|
| 530,411 | 9/1956 | Canada | 52/584 |
| 62,396 | 6/1955 | France | 52/285 |
| 2,452,426 | 5/1976 | Germany | 52/285 |
| 6,800,453 | 7/1969 | Netherlands | 52/438 |
| 107,652 | 6/1943 | Sweden | 52/245 |
| 186,138 | 11/1963 | Sweden | 52/259 |
| 903,845 | 8/1962 | United Kingdom | 52/584 |

*Primary Examiner*—Leslie Braun
*Attorney, Agent, or Firm*—Seidel, Gonda & Goldhammer

[57] ABSTRACT

The invention provides a construction element in particular for towers, silos or the like, wherein there is a panel (10) whose edges form a hollow-shaped section (13) delimited by legs (14) carrying perforations (16) provided for positioning connecting elements (20) joining at least two panels (10) together, the hollow-shaped sections (13) of two panels (10) placed side by side delimiting a chaining recess (15) receiving framework components (22) and a connecting material to constitute the chaining.

6 Claims, 6 Drawing Figures

CONSTRUCTION ELEMENT IN PARTICULAR FOR TOWERS, SILOS OR THE LIKE

The invention provides a construction element making it possible to achieve in particular towers, silos or the like.

The present invention is aimed to achieve constructions such as towers or silos rapidly and easily by means of panels connected to each other by connecting elements ensuring a great solidity to the assembly thus achieved.

Also, the purpose of the invention is to creat simple construction elements, easy to handle and whose costing price is advantageous.

To this end, the invention relates to a construction element in particular for towers, silos or the like, wherein there is a panel whose edges form a hollow-shaped section, delimited by legs carrying perforations for positioning connecting elements joining at least two panels to each other, the juxtaposed hollow-shaped sections of two panels making a chaining recess which receives framework components and a connecting material to constitute the chaining.

According to further characteristic of the invention, the vertical edges of the panel show a hollow-shaped section.

According to another characteristic of the invention, the hollow-shaped sections are generally U-shaped.

According to another characteristic of the invention, the perforation of each leg carries a bore ending into the hollow-shaped section and a reservation ending onto the external surfaces of the panel.

The perforations of these construction elements make it possible to receive the connecting components so as to secure at least two panels to each other.

According to a further characteristic of the invention, the rods connecting two juxtaposed panels to each other are fitted crossing each other so as to form a general X shape.

According to another characteristic of the invention, the connecting rods are bent.

According to another characteristic of the invention, the construction element carries fixing rods for assembling an additional panel on a level with the connecting point of two panels already connected to each other.

According to a further characteristic of the invention, the fixing rod is threaded at one end, carries a T-shaped head or an abutment at its other end and a fixing element embedded in the mass and designed to come within the chaining recess.

Finally, according to a further characteristic of the invention, the panels are either curved, plane or dihedral shaped.

The invention will be more easily understood by means of a mode of embodiment of a construction element diagrammatically shown by way on non-limitative example in the drawings attached thereto, wherein.

Figure 1:
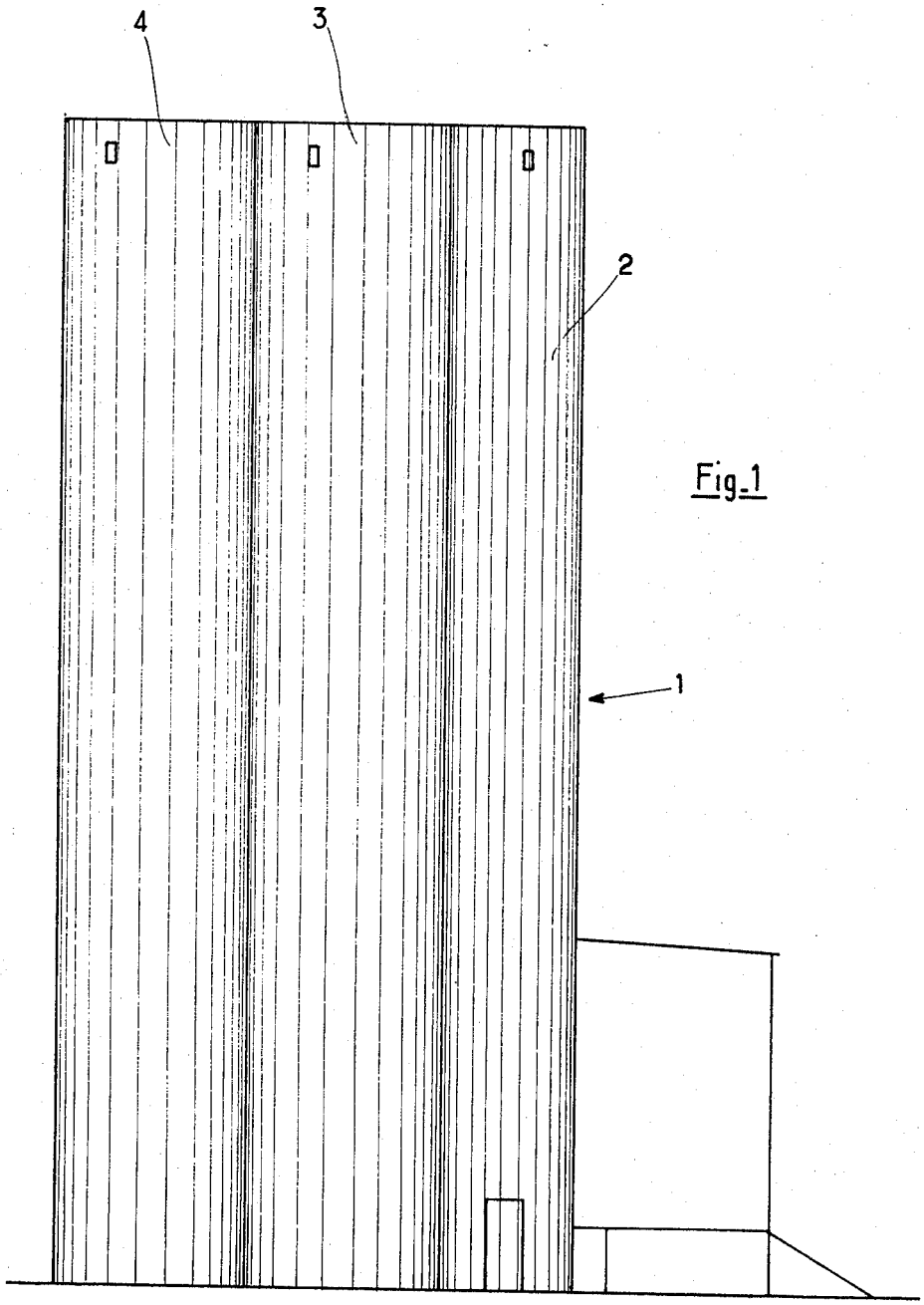
FIG. 1 is a side view of a construction achieved by means of construction elements as provided by the invention.

As shown in FIG. 1, the construction 1 constitutes a center for collecting cereals. This collecting center consists of three elements, a handling tower 2, a first cell 3 and a second cell 4. These three different parts of the construction 1 are each achieved from construction elements such as described hereafter.

Figure 2:
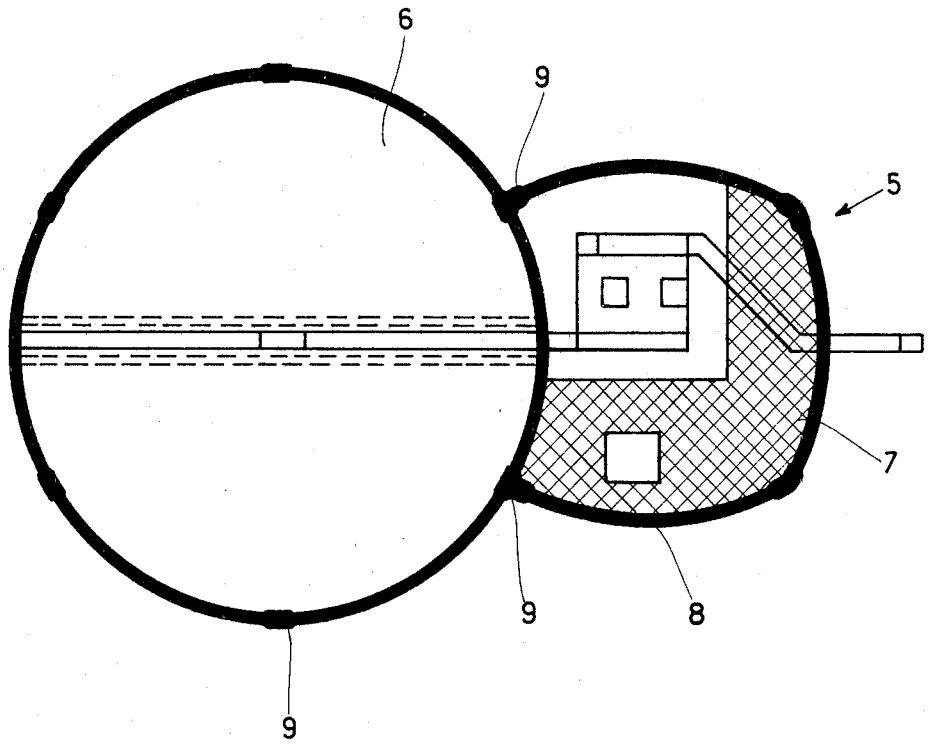
FIG. 2 is a view from above of a construction achieved by means of construction elements according to the invention.

As shown in FIG. 2, the construction 5 consists of a cell 6 to which a handling tower 7 is connected. Both the tower 7 and the cell 6 are achieved by assembling construction elements 8 together. These construction elements 8 are assembled to each other by connections 9. Said connections 9 will be described with more details hereafter.

Figure 3:
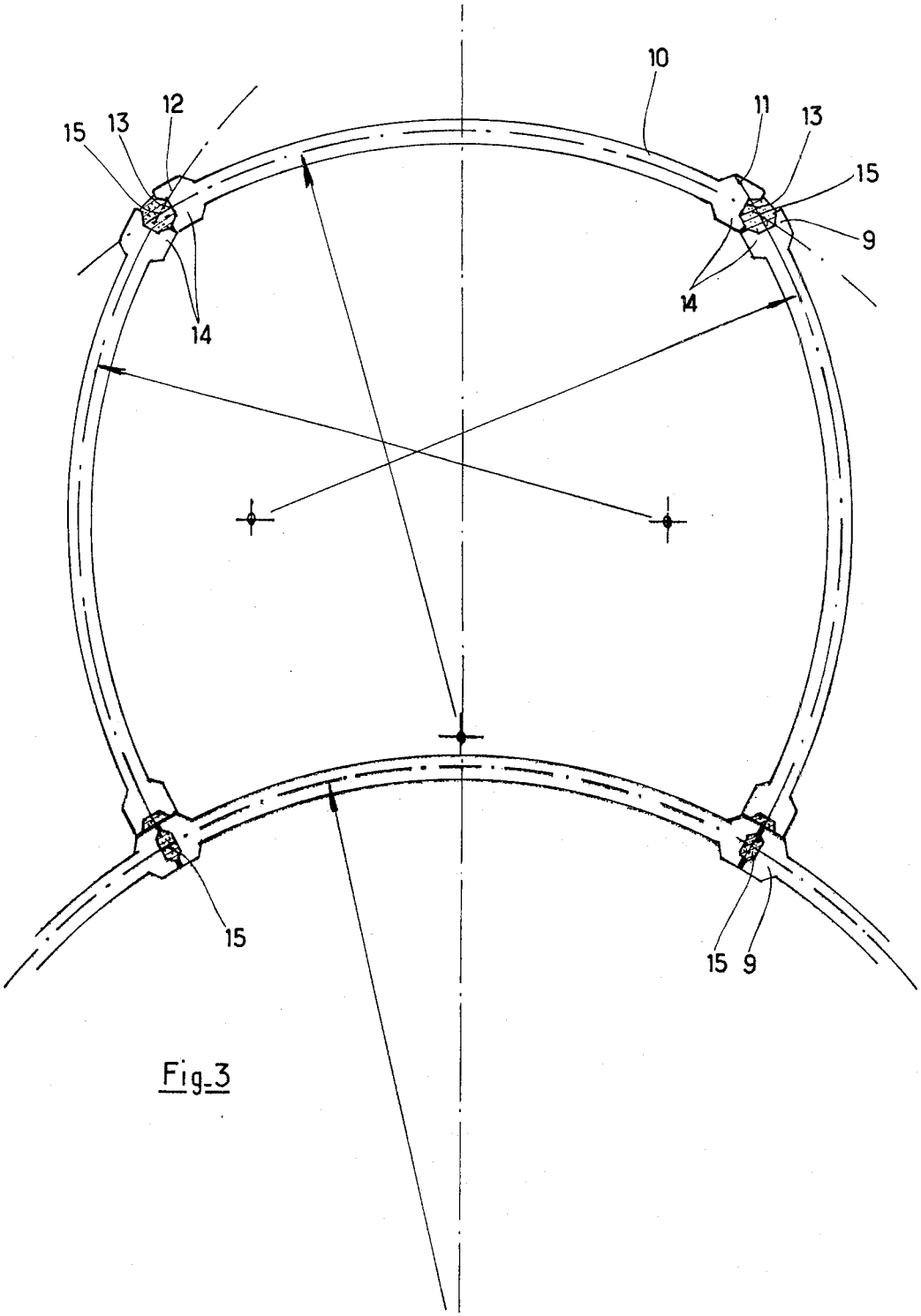
FIG. 3 is a view from above of several construction elements assembled to each other.

As shown in FIG. 3, constructions such as towers or silos can be achieved by means of construction elements 8 assembled on a level with connections 9 to each other. These connections 9 can be of different types and can connect in particular two elements only to each other, or several elements on a level with connections 9.

Each of the elements 8 consists of a curved panel 10 carrying at each of its ends 11, 12, a hollow section 13. Thus, when two panels 10 are joined together, the legs 14 of the hollow sections 13 of two juxtaposed panels 10 come end to end and form chaining recesses 15.

Figure 4:
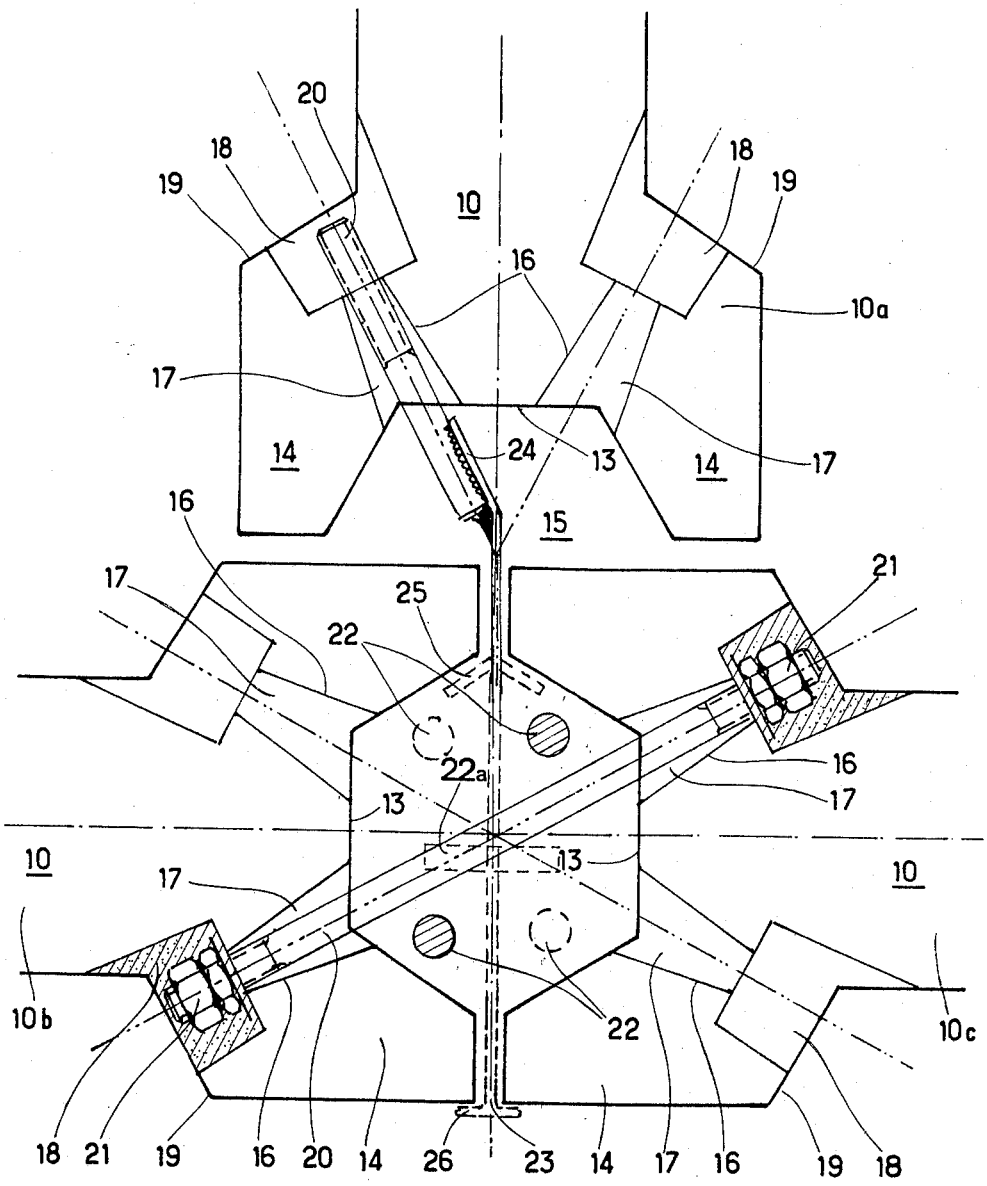
FIG. 4 is a part cross-section view from above of a first type of connection of several construction elements.

As shown in FIG. 4, it is referred to a connection 9. This connection consists of three panels 10 assembled together.

Each panel 10 carries along its vertical edges a hollow-shaped section 13. The hollow sections 13 are delimited by legs 14. When mounting is performed, two panels 10 are assembled together so that the legs 14 make when joined together a chaining recess 15.

Each leg 14 carries a perforation 16. Said perforation 16 carries a bore 17 in the shape of a truncated cone ending on a level with its greater basis into the chaining recess 15 and also a reservation 18 ending on the external surfaces 19 of the panels 10.

Connecting elements are positioned in the perforations 16. Said connecting elements consist of rods 20 threaded at each of their ends so as to receive clamping-bolts 21.

To connect two panels 10 together, a threaded rod 20 is engaged into the perforation 16 diagonally located so that the rods 20 cross each other and thus made a general X shape to connect two panels 10 to each other. When fitting has been performed, the clamping-bolts 21 secure the panels 10 to each other.

When two panels are assembled together, the reservations 18 are filled up through sealing, as well as the chaining recess wherein vertical reinforcements such as chaining steels, static or active reinforcements are arranged. The chaining recess 15 is wedged with concrete after the vertical chaining steels 22 are adjusted and positioned.

It is to be noted that the truncated conical shape of the bores 17 makes positioning of the connecting rods 20 easier.

In the particular mode of embodiment shown in that Figure, a third panel is secured to both the preceding panels 10. The legs 14 of the hollow-shaped section 13 of said third panel 10 are arranged perpendicular to the legs 14 of the two preceding panels 10. A fixing rod 23 must be positioned so as to connect the panel 10*a* to both panels 10*b* and 10*c*. Said fixing rod consists of an end threaded or not 24, of an abutment 25 and of a T-shaped head 26. The end 24 is inclined and catches the connecting rod 20.

So as to make it possible to fit the panels before casting the concrete, the V-shaped abutment 25 applies against the internal walls of the hollow-shaped sections 13 of the panels 10*b* and 10*c* inside the chaining recess 15. Said abutment may also be substituted for a head 26 resting on the external surfaces 19 of the panels 10*b* and 10*c*. The abutments 25, 26 make it possible to fit the panels 10 before wedging is performed.

In addition, a fixing element 22*a* embedded inside the mass of the chaining material is provided.

Figure 5:
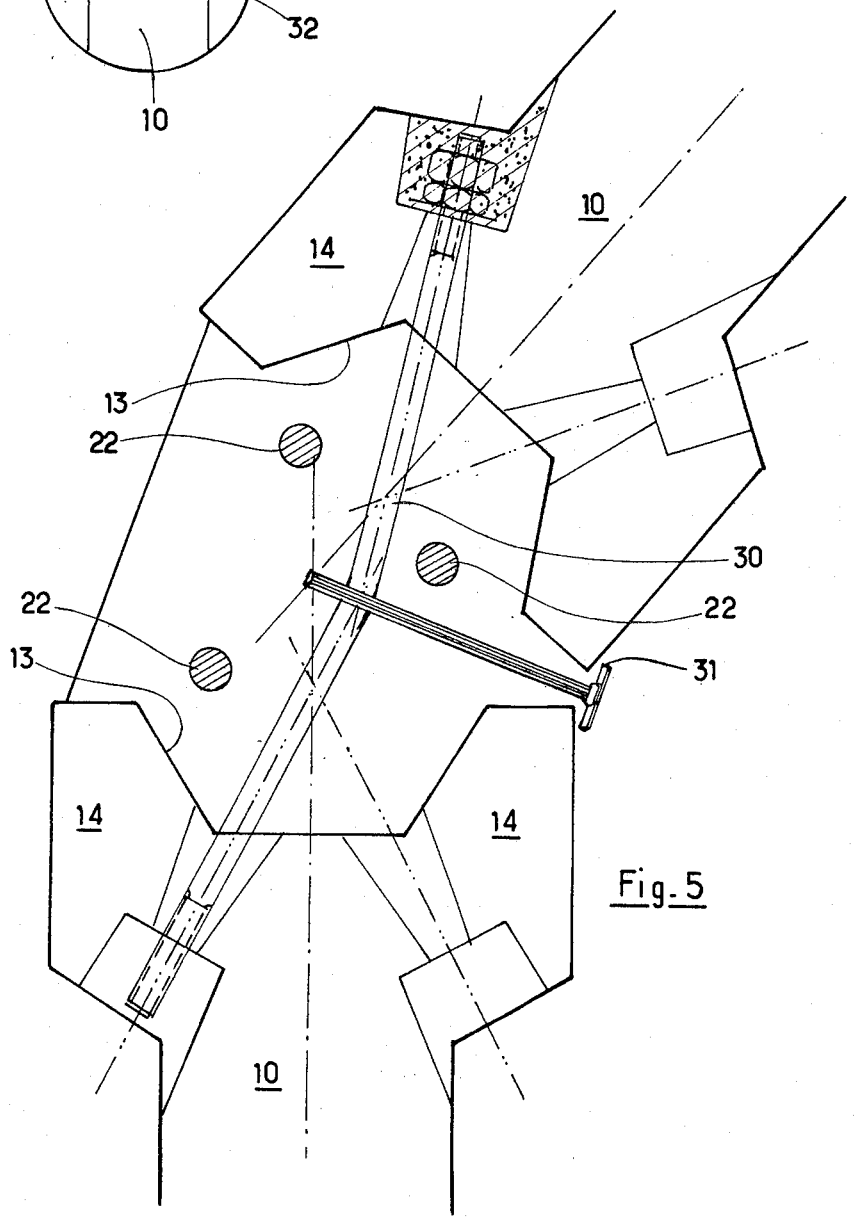
FIG. 5 is a part cross-section view from above of a second type of connection of two construction elements.

As shown in FIG. 5, two panels 10 are connected to each other by a connecting rod 30. Said connecting rod threaded at its two ends is bent in the region of its median portion. In order to reinforce this specific fitting of two panels 10, a balancing piece 31 is provided, which balances the component of "thrust to vacuum".

Such as described hereabove, fitting the panels 10 determines in a level with the legs 14 thereof a chaining recess 15 receiving vertical steels 22, together with the concrete. In this specific case, as in the type of fitting formerly depicted in FIG. 4, the chaining recess makes it possible to achieve vertical poles.

The type of fitting shown in FIG. 5 makes it possible to join two panels 10 together according to any angle whatever, the rod 30 connection the two panels to each other being more or less bent.

Figure 6:
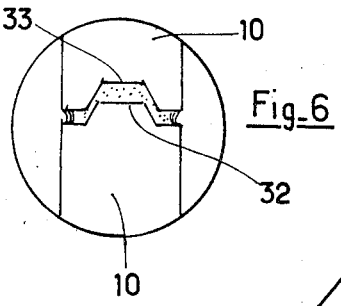
FIG. 6 is a side part view of two panels superposed.

As shown in FIG. 6, the panels 10 are fitted to each other vertically through superposition. The upper edge of the panels 10 carries a protruding portion 32 which perfectly fits the notch 33 of the panel 10 superposed, said notch 33 having a shape corresponding to and complementary with that of the protruding portion 32. The binders and tightness materials designed to fit the panels 10 together, are arranged between said panels 10.

Of course the invention is not limited to the mode of embodiment represented and depicted hereabove, from which other modes and methods of embodiment can be provided without thereby departing from the scope of the invention.

What I claim is:

1. A construction element in particular for towers, silos or the like, comprising:

first, second and third panels;

a pair of legs extending from the vertical edges of each said panel;

said legs defining between them a hollow space;

a hole extending through each leg;

each hole being angled from a major face of said panel toward the center of said panel to the hollow space;

each hole being formed in two portions, a first portion extending from the major face and having a transverse dimension larger than a second portion, said second portion extending from the hollow space and being adapted to receive the end of a rod completely therein;

said second portion being in the form of a truncated cone for aiding in the alignment of a rod passing therethrough;

a pair of rods passing through the holes of said first and second panels and crossing in a generally X-shaped configuration to connect said first and second panels in an end to end relationship whereby the hollow spaces of said first and second panels delimit a chaining recess;

the ends of said rods in said first portions being threaded to receive nuts thereon;

said third panel being connected to said first and second panels by a connecting member;

a first section of said connecting member passing through one of the holes in a leg of said third panel and a second section of said connecting member passing between adjacent ends of said first and second panels and into said chaining recess.

2. A construction element in accordance with claim 1 wherein said first section of said connecting member is a connecting rod, at least one end of said connecting rod is threaded, said second section is a fixing rod having at least one projection for contacting a portion of a leg on each of said first and second panels.

3. A construction element in accordance with claim 2 wherein said projection includes a pair of arms, one arm extending into the hollow space of said first panel and contacting an internal wall of a leg of said first panel, the other arm extending into the hollow space of said second panel and contacting an internal wall of a leg of said second panel.

4. A construction element in accordance with claim 3 wherein said fixing rod is threaded at one end for threaded engagement with said connecting rod and the other end of said fixing rod has a T-shaped head.

5. A construction element in accordance with claim 4 wherein the threaded end of said fixing rod is inclined relative to the portion of said fixing rod passing into said chaining recess.

6. A construction element in particular for towers, silos or the like, comprising:

first and second prefabricated panels;

a pair of legs extending from the vertical edges of each said panel;

said legs defining between them a hollow space;

the hollow spaces of two panels placed side by side delimiting a chaining recess;

a hole extending through each leg;

each hole being angled from a major face of said panel toward the center of said panel to the hollow space;

each hole being formed in two portions, a first portion extending from the major face and having a transverse dimension larger than a second portion, said second portion extending from the hollow space and being adapted to receive the end of a rod completely therein;

said second portion being in the form of a truncated cone for aiding in the alignment of a rod passing therethrough;

said first and second panels being disposed at an angle relative to one another;

a rod passing through a hole in said first panel and passing through a hole in said second panel;

said rod being bent to thereby secure said first and second panels at an angle relative to one another;

the ends of said rod in said first portions being threaded to receive nuts thereon; and a second rod having a T-shaped head extending past the outer faces of a pair of adjacent legs from said first and second panels and the other end of said second rod extending into said chaining recess.

* * * * *